US006890170B2

(12) United States Patent
Bäcker et al.

(10) Patent No.: US 6,890,170 B2
(45) Date of Patent: May 10, 2005

(54) HEATER WITH GLOW PLUG/FLAME MONITOR

(75) Inventors: Christian Bäcker, Fuerstenfeldbruck (DE); Werner Höglmaier, Aichach (DE); Felix Wolf, Augsburg (DE)

(73) Assignee: Webasto Thermosysteme International GmbH, Stockdorf (DE)

( * ) Notice: Subject to any disclaimer, the term of this patent is extended or adjusted under 35 U.S.C. 154(b) by 108 days.

(21) Appl. No.: 10/622,139

(22) Filed: Jul. 18, 2003

(65) Prior Publication Data

US 2004/0118934 A1 Jun. 24, 2004

(30) Foreign Application Priority Data

Jul. 19, 2002 (DE) ..... 102 33 049

(51) Int. Cl.[7] ..... F23N 5/00

(52) U.S. Cl. ..... 431/3; 431/11; 431/72; 431/259

(58) Field of Search ..... 431/3, 11, 16, 431/41, 72, 208, 259, 326, 328; 60/39.281; 123/179.21

(56) References Cited

U.S. PATENT DOCUMENTS

| | | | | |
|---|---|---|---|---|
| 4,308,463 A | * | 12/1981 | Giras et al. | 290/40 R |
| 4,352,656 A | * | 10/1982 | Michaud et al. | 431/72 |
| 4,778,377 A | * | 10/1988 | Kawamura | 431/41 |
| 5,402,757 A | * | 4/1995 | Eller et al. | 123/179.21 |
| 6,743,012 B2 | * | 6/2004 | Wolf | 431/353 |

FOREIGN PATENT DOCUMENTS

| | | |
|---|---|---|
| DE | 198 22 140 C1 | 8/1999 |
| DE | 199 03 305 A1 | 8/2000 |

* cited by examiner

*Primary Examiner*—Stephen Gravini
(74) *Attorney, Agent, or Firm*—Nixon Peabody LLP; David S. Safran

(57) ABSTRACT

A heater in which, during the glow plug ramp time interval, the amount of energy supplied per unit of time to the glow plug/flame monitor can be successively changed, and a control unit which is operationally coupled to the glow plug/flame monitor. To enable continuous flame monitoring during the starting phase of the heater with the control unit, the resistance value of the glow plug/flame monitor is determined during the glow plug ramp time interval and compared to a threshold value $R_{GS}$, and when the threshold value $R_{GS}$ is not reached, a flame-out signal is generated.

19 Claims, 1 Drawing Sheet

HEATER WITH GLOW PLUG/FLAME MONITOR

BACKGROUND OF THE INVENTION

1. Field of the Invention

The invention relates to a heater with a glow plug/flame monitor in which, during glow plug ramp time intervals, the amount of energy supplied per unit of time can be successively changed, especially reduced, and with a control unit which is operationally coupled to the glow plug/flame monitor. Furthermore, the invention relates to a motor vehicle which is provided with such a heating device.

2. Description of Related Art

German Patent DE 198 22 140 C1 discloses a process for flame monitoring in a motor vehicle heater in which the resistance value of a glow plug is evaluated, during glow pauses in which there is no power supply voltage on the glow plug, by a control unit for detecting a flame in a combustion chamber. Monitoring takes place by checking whether the glow coils of the glow plug assume a predetermined resistance value within a given time interval.

Published German Patent Application DE 199 03 305 A1 discloses a process for monitoring the flame in a motor vehicle heater which is provided with a temperature sensor or flame monitor which projects into the combustion chamber. The measurement signal of the flame monitor is supplied to a control unit and is evaluated for flame detection depending on a given temperature threshold value and additionally the temperature gradient. With this process, flame-out detection is possible after the starting element, in the form of a flame monitor or glow plug, has been completely turned off.

Existing methods of flame monitoring by means of a glow plug/flame monitor have the disadvantage that during the starting phase, i.e., during glow operation of the glow plug, continuous monitoring of the flame is not possible. This problem arises especially for small heaters up to 5 kW heat output. Extreme smoke emissions can occur to some extent by flame blow-off during the currently unmonitored starting phase.

SUMMARY OF THE INVENTION

A primary object of the present invention is to provide a motor vehicle with a heater in which continuous flame monitoring is possible even during the starting phase of the heater.

This object is achieved with a heater of the type in which, with the control unit, the resistance value of the glow plug/flame monitor is determined during the glow plug ramp time interval and can be compared to a threshold value $R_{GS}$, and when the threshold value $R_{GS}$ is not reached, a flame-out signal can be generated. Furthermore, the object is achieved with a vehicle which is provided with such a heater of the invention.

The invention is based on the finding that, during the starting phase and thus during the glow plug ramp time interval, the electric power supplied to the glow plug/flame monitor successively changes, in particular is reduced, and that this change or reduction leads to a change of the resistance value of the glow plug/flame monitor. By taking into account the change of the resistance value based on the electric power supplied to the glow plug/flame monitor during flame detection, via a control unit, flame detection can even be detected during the glow plug ramp time interval. A correspondingly matched threshold value is used to generate the flame-out signal.

The invention can be used during a glow plug ramp time interval in which the electrical power supplied to the glow plug is successively reduced and/or raised. The following explanation is in regard to the time-dependent change of values with respect to a reduction and/or an increase of electrical power, with the correspondingly matched signs. The device of the invention and the pertinent process are particularly well suited for glow plug ramp time intervals in which the supplied electrical power is successively reduced.

In the present invention, flame monitoring during a glow plug ramp is possible such that, in this operating state of the heater, there is a prompt reaction to flame blow-off.

In one preferred embodiment of the invention, the threshold value $R_{GS}$ can be changed by a time-dependent function over the glow plug ramp time interval. In this embodiment, therefore, a threshold value which can be changed as a function of time is used, and by which especially accurate and prompt flame-out detection is possible.

The indicated time-dependent function is advantageously determined at least as a function of the resistance value $R_{start}$ of the glow plug at the start of glow plug ramp time interval. The resistance value at the start of the glow plug ramp time interval forms a relative starting point for the reduction or increase to follow which can then be anticipated by a corresponding estimate by further consideration with relative accuracy.

The change of the resistance value can be determined in a simple and moreover relatively accurate manner as a characteristic, particularly a linear characteristic, between the resistance value $R_{start}$ of the glow plug at the start and the resistance value $R_{end}$ of the glow plug at the end of the glow plug ramp time interval. The indicated function is then determined as $R_{GS}=f(t; R_{start}; R_{end})$, especially as $R_{GS}=t^*(R_{start}-R_{end})/t_{total}$, t being the transpired time and $t_{total}$ being the total time of the glow plug ramp time interval.

In order to establish a threshold value for flame-out detection, the latter function can be advantageously provided with an offset which fixes the range of the still allowable change of the resistance value. A change of the resistance value which exceeds this range then leads to a corresponding flame-out signal.

The offset can be established as an offset which remains the same over the entire glow plug ramp time interval, as a so-called function offset Y. The indicated function is then determined as $R_{GS}=f(t; R_{start}; R_{end})-Y$, especially as $R_{GS}=t^*(R_{start}-R_{end})/t_{total}-Y$. This function can be accomplished economically in a control unit and can be used to determine the threshold value.

Alternatively or additionally, one offset A and B of the function-determining resistance value at a time can be used as the offset such that the function is determined as $R_{GS}=f(t; A^*R_{start}; B^*R_{end})$, especially as $R_{GS}=t^*(A^*R_{start}-B^*R_{end})/t_{total}$.

The change of the resistance value as a result of the supplied electrical power can, moreover, be determined by experimentally determining the resistance value $R_{end}$ of the glow plug at the end in the glow plug ramp time interval and by its being determined as a function of the resistance value $R_{start}$ of the glow plug at the start as $R_{end}=f(R_{start})$, especially as $R_{end}=X^*R_{start}$ where X is a some numerical value.

This determination can be incorporated into the indicated function so that it is determined, overall, as $R_{GS}=f(t; A^*R_{start}; B^*R_{end})$, with $R_{end}=f(R_{start})$, especially as $R_{GS}t^*$ $(A*R_{start}-B*x*R_{end})/t_{total}$. Time-dependent establishment of the indicated threshold value based on this function and corresponding comparative monitoring of the resistance value of the glow plug/flame monitor which actually occurs lead to a particularly reliable flame detection during the glow phase of the glow plug/flame monitor.

Alternatively or additionally, in the flame monitoring of the invention, gradient evaluation of the characteristic of the resistance value can be used, in turn the effect of the electrical power which has been supplied to the glow plug/flame monitor being considered during the monitoring phase.

The embodiments of the invention are explained in detail below and illustrated in the drawing figures.

DETAILED DESCRIPTION OF THE INVENTION

Figure 1:
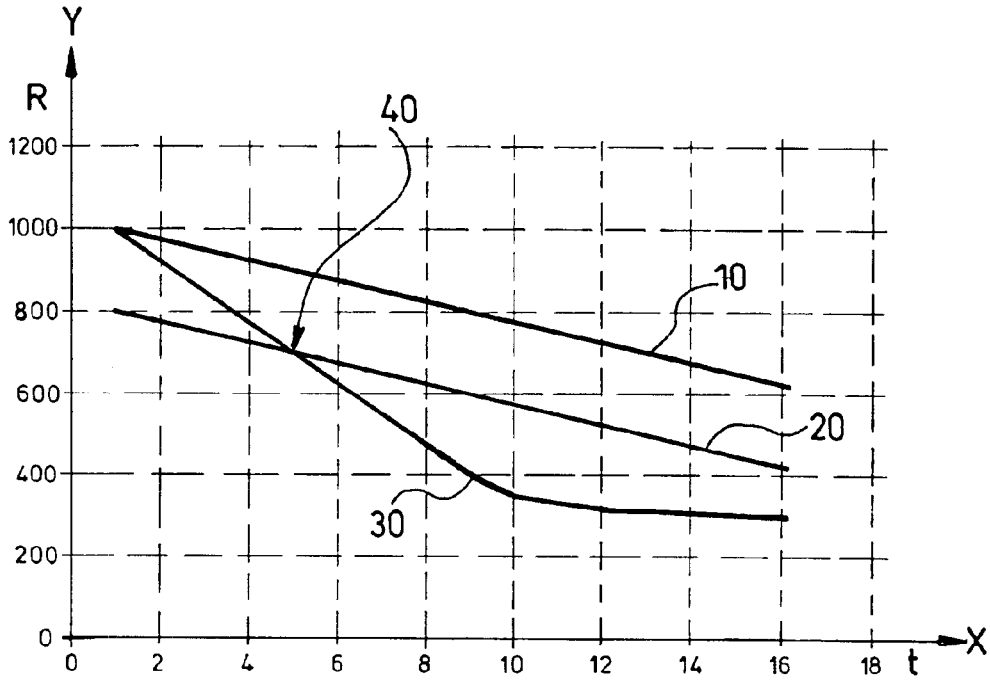
FIG. 1 is a diagram of the characteristics of a threshold value of the invention for flame detection over time during a glow plug ramp time interval, and a characteristic each of the resistance value of a glow plug over time for flame-on and flame-out.

In FIG. 1, on the X-axis, a characteristic is plotted over time in the unit seconds (sec). The Y-axis illustrates resistance values in the unit milliohm (mΩ).

Figure 1A:
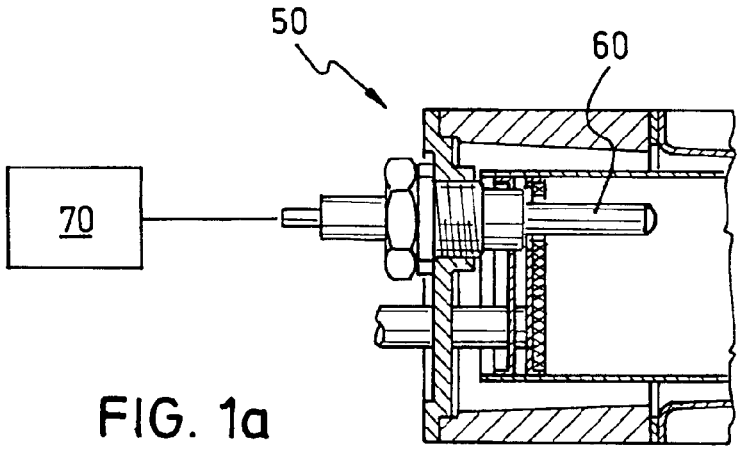
FIG. 1*a* shows a glow plug of a heater with the control unit of the invention.

The line or curve 10 of FIG. 1 shows the characteristic of the resistance value of a glow plug 60, illustrated in FIG. 1*a*, on the burner of a heater 50 during a glow plug ramp time interval (i.e., during the glow process) for a flame-on situation. The line or curve 20 shows the characteristic of a threshold value which changes over time and which is determined based on a function $R_{GS}=f(t)$ xx. Finally, the line or curve 30 shows the characteristic of the resistance value on the glow plug in the presence of a flame-out situation.

The function $R_{GS}$ is determined proceeding from a resistance value $R_{start}$ of the glow plug at the start of the glow plug ramp time interval of 1000 mΩ. Then a linear characteristic between the resistance value $R_{start}$ of the glow plug and the resistance value $R_{end}$ of the glow plug at the end of the glow plug ramp time interval is assumed. The resistance value $R_{end}$ has been experimentally determined to be roughly more than 600 mΩ.

The resulting function $R_{GS}=f(t; R_{start}; R_{end})$, particularly, $R_{GS}=t*(R_{start}-R_{end})/t_{total}$, t being the transpired time and $t_{total}$ being the total time of the glow plug ramp time interval, has furthermore been assigned an offset y of 200 mΩ so that the characteristic of the line 20 is determined by the function $R_{GS}=f(t; R_{start}; R_{end})-Y$, especially $R_{GS}=t*(R_{start}-R_{end})/t_{total}-Y$. This function is simulated in the control unit 70 attached to the heater 50 which is used for determining the threshold value which changes over time in the flame-out detection.

During the glow plug ramp time interval, the actual characteristic of the resistance value on the glow plug is compared to the time-variable threshold value according to the aforementioned function. If a flame-out situation occurs, the actual resistance value drops below the threshold value; this is illustrated in FIG. 1 at reference number 40. The failure to reach the threshold value is detected by the control unit 70 of the heater 50 and the heater is controlled according to the current flame-out situation. For example, blowing out the combustion chambers, changing the fuel delivery, and/or re-ignition of the fuel are parameters controlled by the control unit. With this type of flame detection, a rapid reaction to flame blow-off is possible even during the glow plug ramp time interval.

What is claimed is:

1. A heater comprising, a glow plug or flame monitor in which, during a glow plug ramp time interval, the amount of energy supplied per unit of time is successively changable, and a control unit which is operationally coupled to the glow plug or flame monitor, wherein the control unit is operative for determining a resistance value of the glow plug or flame monitor during the glow plug ramp time interval, for comparing the resistance value determined to a threshold value $R_{GS}$, and for generating a flame-out signal when the threshold value $R_{GS}$ is not reached during the glow plug ramp time interval.

2. The heater as claimed in claim 1, wherein the threshold value $R_{GS}$ changed in accordance with a function $R_{GS}=f(t)$ in dependence on a time t during the glow plug ramp time interval.

3. The heater as claimed in claim 2, wherein the function is determined depending on a resistance value $R_{start}$ of the glow plug or flame monitor at the start of the glow plug ramp time interval.

4. The heater as claimed in claim 2, wherein the function is determined by a characteristic of the resistance value that is linear between a resistance value $R_{start}$ of the glow plug or flame monitor at the start of the glow plug ramp time interval and a resistance value $R_{end}$ of the glow plug or flame monitor at the end of the glow plug ramp time interval where $R_{GS}=f(t; R_{start}; R_{end})$.

5. The heater as claimed in claim 4, wherein the function is further determined by an offset to provide the characteristic.

6. The heater as claimed in claim 5, wherein the offset is a function offset Y such that the function is determined as $R_{GS}=f(t; R_{start}; R_{end})-Y$.

7. The heater as claimed in claim 5, wherein the offset is one of offset values A and B, each being function-determining resistance values such that the function is determined as $R_{GS}=t*(A*R_{start}-B*R_{end})$.

8. The heater as claimed in claim 4, wherein the resistance value $R_{end}$ of the glow plug is either experimentally determined at the end in the glow plug ramp time interval or is determined as a function of the resistance value $R_{start}$ of the glow plug at the start of the ramp time interval such that $R_{end}=f(R_{start})$.

9. The heater as claimed in claim 7, wherein the function is determined as $R_{GS}=f(t; A*R_{start}; B*R_{end})$, with $R_{end}=f(R_{start})$.

10. The heater as claimed in claim 2, wherein the function is determined by a characteristic of the resistance value that is linear between the resistance value $R_{start}$ of the glow plug or flame monitor at the start of the glow plug ramp time interval and the resistance value $R_{end}$ of the glow plug or flame monitor at the end of the glow plug ramp time interval where $R_{GS}=t*(R_{start}-R_{end})/t_{total}$.

11. The heater as claimed in claim 10, wherein the function is further determined by an offset to provide the characteristic.

12. The heater as claimed in claim 11, wherein the offset is a function offset Y such that the function is determined as $R_{GS}=t*(R_{start}-R_{end})/t_{total}-Y$.

13. The heater as claimed in claim 4, wherein the resistance value $R_{end}$ of the glow plug is determined as a function of the resistance value $R_{start}$ of the glow plug at the start of the ramp time interval such that $R_{end}=X*R_{start}$ where X is a numerical value.

14. The heater as claimed in claim 7, wherein the function is determined as $R_{GS}=t*(A*R_{start}-B*x\ R_{end})/t_{total}$, with $R_{end}=f(R_{start})$.

15. A motor vehicle including a heater, the heater comprising, a glow plug or flame monitor in which, during a glow plug ramp time interval, the amount of energy supplied per unit of time is successively changable, and a control unit which is operationally coupled to the glow plug or flame monitor, wherein the control unit is operative for determining a resistance value of the glow plug or flame monitor during the glow plug ramp time interval, for comparing the resistance value determined to a threshold value $R_{GS}$, and for generating a flame-out signal when the threshold value $R_{GS}$ is not reached during the glow plug ramp time interval.

16. A motor vehicle including the heater set forth in claim 15, wherein the threshold value $R_{GS}$ changed in accordance with a function $R_{GS}=f(t)$ in dependence on a time t during the glow plug ramp time interval.

17. A motor vehicle including the heater set forth in claim 16, wherein the function is determined by a characteristic of the resistance value that is linear between a resistance value $R_{start}$ of the glow plug or flame monitor at the start of the glow plug ramp time interval and a resistance value $R_{end}$ of the glow plug or flame monitor at the end of the glow plug ramp time interval where $R_{GS}=f(t;\ R_{start};\ R_{end})$.

18. A motor vehicle including the heater set forth in claim 17, wherein the function is further determined by a function offset Y such that the function is determined as $R_{GS}=f(t;\ R_{start};\ R_{end})-Y$.

19. A motor vehicle including the heater set forth in claim 18, wherein the resistance value $R_{end}$ of the glow plug is either experimentally determined at the end in the glow plug ramp time interval or is determined as a function of the resistance value $R_{start}$ of the glow plug at the start of the ramp time interval such that $R_{end}=f(R_{start})$.

* * * * *